US007987892B2

(12) United States Patent
Kato et al.

(10) Patent No.: US 7,987,892 B2
(45) Date of Patent: Aug. 2, 2011

(54) SPHERICAL CASTING SAND

(75) Inventors: Masayuki Kato, Aichi (JP); Yoshimitsu Ina, Aichi (JP)

(73) Assignee: Kao Corporation, Tokyo (JP)

( * ) Notice: Subject to any disclaimer, the term of this patent is extended or adjusted under 35 U.S.C. 154(b) by 548 days.

(21) Appl. No.: 11/883,388

(22) PCT Filed: Jan. 31, 2006

(86) PCT No.: PCT/JP2006/301931

§ 371 (c)(1),
(2), (4) Date: Nov. 19, 2007

(87) PCT Pub. No.: WO2006/082949

PCT Pub. Date: Aug. 10, 2006

(65) Prior Publication Data

US 2008/0138650 A1 Jun. 12, 2008

(30) Foreign Application Priority Data

Feb. 2, 2005 (JP) ..... 2005-025872

(51) Int. Cl.
*B22C 1/00* (2006.01)
*B22C 9/02* (2006.01)

(52) U.S. Cl. ..... 164/15; 164/525; 164/349

(58) Field of Classification Search ..... 164/15, 164/349, 525

See application file for complete search history.

(56) References Cited

U.S. PATENT DOCUMENTS

| | | | | |
|---|---|---|---|---|
| 7,673,668 | B2 * | 3/2010 | Sakaguchi et al. | 164/15 |
| 2006/0005937 | A1 | 1/2006 | Sakaguchi et al. | |

FOREIGN PATENT DOCUMENTS

| | | | |
|---|---|---|---|
| EP | 1 595 617 | A1 | 11/2005 |
| JP | 2001-205386 | A | 7/2001 |
| JP | 2002-113549 | A | 4/2002 |
| JP | 2004-202577 | A | 7/2004 |
| JP | 2004-237288 | A | 8/2004 |
| JP | 2004-255451 | A | 9/2004 |
| JP | 2004-358531 | A | 12/2004 |
| WO | WO-2004/052572 | A1 | 6/2004 |

OTHER PUBLICATIONS

"Chemical binders—back to basics," Foundery Trade Journal, vol. 167, No. 3476, Jun. 4, 1993, XP-000361344, pp. 311-312, 314-316, 318-319.

Burditt et al., "Mold & Core Binders Keep Pace with Industry Demands," Modern Casting, vol. 78, Jun. 1988, No. 6, pp. 20-24, XP-000020514.

* cited by examiner

*Primary Examiner* — Kevin P Kerns

(74) *Attorney, Agent, or Firm* — Birch, Stewart, Kolasch & Birch, LLP

(57) ABSTRACT

A spherical casting sand having an average particle diameter of 0.03 to 1.5 mm, produced by a flame fusion method, usable together with a urethane binder. Casting sands capable of producing a mold having higher strength and excellent surface smoothness without deformation or breakage with fewer gas defects in producing a mold by using a urethane binder in the cold box process or in the urethane self-hardening mold making method. The casting sand has longer bench life in the cold box process. Amount of generated gas that is a problem of the mold making method using a urethane binder can be significantly reduced, and a casting with fewer gas defects can be obtained.

11 Claims, 1 Drawing Sheet

SPHERICAL CASTING SAND

FIELD OF THE INVENTION

The present invention relates to spherical casting sand, a mold using the same, a method for manufacturing the same, and a casting obtained by the mold.

BACKGROUND OF THE INVENTION

As a method for manufacturing casting molds (including various granular aggregate members of mold assembly), a urethane self-hardening mold making method or a cold box process wherein a binder containing organic solvent solutions containing primarily a polyol compound and a polyisocyanate compound, respectively, is mixed with granular aggregate such as silica sand, and the resulting mixture is charged into a pattern and hardened by urethanization reaction by the catalytic action of a tertiary amine thereby giving a desired mold is widely known and conducted. These mold making methods have advantages such as hardening ability at room temperature, rapid hardening, and excellent mold collapsibility after casting to facilitate separation from a casting, and thus these methods are increasingly used as energy-saving and highly productive mold making methods.

To prevent gas defects in the cold box process or the urethane self-hardening mold making method, a method of reducing the additive amount by increasing a binder increasing strength or a method of preventing gas defects by using various additives (JP-A 2004-255451).

In the cold box process, a method of extending bench life is disclosed (JP-A 2004-358531).

As casting sand excellent in fluidity and capable of producing a high-strength mold having a smooth surface, specific spherical casting sand is disclosed in JP-A 2004-202577.

SUMMARY OF THE INVENTION

The present invention relates to spherical casting sand having an average particle diameter of 0.03 to 1.5 mm, produced by a flame fusion method, usable together with a urethane binder.

The present invention also relates to spherical casting sand having an average particle diameter of 0.03 to 1.5 mm and a water absorption of 0.5 wt % or less, usable together with a urethane binder.

Further, the present invention relates to a method for manufacturing a mold, including a step of mixing the spherical casting sand of the present invention with a urethane binder.

Furthermore, the present invention relates to use of the spherical sand as casting sand usable together with a urethane binder.

Finally, the present invention relates to a mold containing the spherical casting sand of the present invention and a urethane binder and to a casting product obtained with the mold.

DETAILED DESCRIPTION OF THE INVENTION

Since a conventional mold having a thin-wall portion is particularly enclosed in casting, gas cannot escape to the outside and therefore gas defects happen frequently.

In the case of the mold having a thin-wall portion, the strength of the mold is improved by increasing the amount of a binder in order to prevent breakage (for example, core rupture etc.) after casting. The increase in the amount of a binder leads to gas defects, thus making gas defects more problematic.

In the cold box process, a mold is hardened by mixing with a phenol resin component and a polyisocyanate component and then passing a gaseous amine therethrough, but before passing the amine, an urethanization reaction may gradually proceed to initiate hardening. Accordingly, a mold composition stored in a sand hopper for a long time may fail to attain a desired mold strength, to cause defects in mold making and necessitate cleaning of the sand hopper, so a mold composition having a longer bench life has been desired.

The present invention relates to casting sand capable of producing a mold having higher strength and excellent surface smoothness without deformation or breakage with fewer gas defects in producing a mold by using a urethane binder such as in the cold box process or in the urethane self-hardening mold making method. Further, the present invention relates to casting sand having a longer bench life in the cold box process.

According to the present invention, the amount of generated gas that is the problem of the mold making method using a urethane binder can be significantly reduced, and a casting with fewer gas defects can be obtained.

When a core having a thin-wall portion is formed, a core of high strength with sand filled well therein can be produced, and a mold having a complicated shape not achieved in the prior art can be produced.

Further, the spherical casting sand of the present invention, after being mixed with a polyol component and an isocyanate component, has a long bench life and can reduce defects in making a mold and can increase mold productivity.

A part using its casting can thereby be endowed with values such as weight saving, high strength, integration with another part, and cooling properties.

The spherical casting sand used in the present invention has mainly 2 aspects and is preferable for use in a core. The first aspect is spherical casting sand having an average particle diameter of 0.03 to 1.5 mm, produced by the flame fusion method. The second aspect is spherical casting sand having an average particle diameter of 0.03 to 1.5 mm and a water absorption of 0.5 wt % or less. Hereinafter, these two sands are sometimes referred to collectively as "spherical casting sand".

The term "spherical" as used in the spherical casting sand of the invention refers to a sphericity of 0.88 or more, preferably 0.90 or more. From the viewpoint of demonstrating the effect of the invention, casting sand having a sphericity of 0.95 or more is preferable. Whether the casting sand is spherical or not can be judged by observing the casting sand under an optical microscope or a digital scope (for example, VH-8000 manufactured by Keyence Corporation) as described later in the Examples.

The major component of the spherical casting sand of the present invention is not particularly limited and may be a conventionally known refractory or refractory material rendered spherical by the flame fusion method. From the viewpoint of fire resistance and availability, the spherical casting sand is preferably sand containing $SiO_2$ as a major component, sand containing $Al_2O_3$ and $SiO_2$ as major components, or sand containing MgO and $SiO_2$ as major components, out of the refractory and refractory materials. Among these, the casting sand containing $Al_2O_3$ and $SiO_2$ as major components is more preferable.

As used herein, the "major components" are component contained in a total amount of 60 wt % or more based on the whole components of the casting sand. From the viewpoint of improvement of fire resistance, the total amount of the major components is preferably 85 to 100 wt %, more preferably 90 to 100 wt %, based on the whole component of the spherical casting sand.

Components which can be contained as those other than the major component in the spherical casting sand of the invention include, for example, metal oxides such as $Fe_2O_3$, $TiO_2$, $K_2O$ and $Na_2O$. These components are derived from the starting material.

When $Fe_2O_3$ and $TiO_2$ are contained, the content of each of them is preferably 5 wt % or less. The content of $Fe_2O_3$ is more preferably 2.5 wt % or less, even more preferably 2 wt % or less. When $K_2O$ and $Na_2O$ are contained, their content as the total amount is preferably 3 wt % or less, more preferably 1 wt % or less.

When $Al_2O_3$ and $SiO_2$ are used as the major components, the $Al_2O_3/SiO_2$ ratio by weight is preferably 1 to 15. The ratio is more preferably 1.2 to 12, even more preferably 1.5 to 9, from the viewpoint of improvement of fire resistance and reclamation efficiency of the casting sand. When $Al_2O_3$ and $SiO_2$, or $SiO_2$ only, is used as the major component, CaO and MgO can be contained as components other than the major component. In this case, their content as the total amount is preferably 5 wt % or less, from the viewpoint of improvement of the fire resistance of the spherical casting sand.

When MgO and $SiO_2$ are used as the major components, the $MgO/SiO_2$ ratio by weight is preferably 0.1 to 10. The ratio is more preferably 0.2 to 9, even more preferably 0.3 to 5, from the viewpoint of easiness in rendering sand spherical, corrosion resistance, fire resistance and the efficiency of reclamation of the casting sand.

When MgO and $SiO_2$ are the major components, $Al_2O_3$ can be contained as a component other than the major components. This component is derived from the material, and its content is preferably 10 wt % or less from the viewpoint of improvement of the corrosion resistance of the spherical casting sand.

From the viewpoint of preventing reduction in bench life, the amount of acid (ml/50 g) consumed by the casting sand of the present invention is preferably 10 (ml/50 g) or less, more preferably 5 (ml/50 g) or less. The method of measuring the amount of acid consumed is a method described in JACT Test Method S-4 wherein 50 g dry sand is stirred in 0.1 mol/L aqueous hydrochloric acid and then the sand is removed, and the reaction solution is subjected to back titration to pH 7 with 0.1 mol/L aqueous sodium hydroxide.

From the viewpoint of preventing reduction in bench life, the amount of alkali eluted per g of the casting sand of the present invention is preferably not higher than 1 μmol/g, more preferably not higher than 0.8 μmol/g.

The amount of eluted alkali refers to the amount of a strong alkali component extracted from casting sand with water, and is defined as follows. 50 ml water is added to 50 g casting sand, then stirred for 15 minutes, left for 15 minutes and decanted, and the aqueous layer obtained by decantation is used as an eluate. 25 ml of the eluate is collected, and then measured for its pH and simultaneously subjected to neutralization titration with 0.1 mol/L aqueous hydrochloric acid to give a titration curve from which the titer (ml) with the inflection point as point of neutralization, and the pH at this point, are read.

From the titer at the point of neutralization in the alkali region (that is, in the region of pH 7 or more), the amount of eluted alkali is determined according to the equation below. When there are 2 or more points of neutralization at pH 7 or more, the point of neutralization of pH of 7 or more and the lowest pH is selected, while when there is no point of neutralization of above pH 7, the amount of eluted alkali is regarded as 0 (μmol/g).

$$\text{The amount of eluted alkali } (\mu\text{mol/g}) = \text{titer (ml) at the point of neutralization} \times 0.1 \times 50/25/50 \times 1000$$

The amount of acid consumed is an amount of not only acid reacting with an eluted alkali from casting sand but also acid reacting with the surface of sand. Particularly, the sand produced by the flame fusion method is estimated to have many functional groups on the surface of the sand, so that even if the amount of acid consumed by the sand is high, the sand has a long bench life in some cases. Accordingly, the amount of eluted alkali exerting a significant influence on bench life is preferably measured. Particularly, the Ca content in eluted alkali components has a significant influence, so its reduction is preferable.

From the viewpoint of reducing the amount of acid consumed and the amount of alkali eluted, the content of each of $Na_2O$ and $K_2O$ in the casting sand composition is preferably 0.8 wt % or less, more preferably 0.5 wt % or less, even more preferably 0.3 wt % or less. The content of CaO is preferably 1 wt % or less, more preferably 0.5 wt % or less. When the major component in the casting sand is $SiO_2$ and/or $Al_2O_3$, the content of MgO is preferably 1 wt % or less, more preferably 0.5 wt % or less. With these contents given, the amount of acid consumed and the amount of alkali eluted can be reduced thereby preventing reduction in bench life.

The coefficient of thermal expansion of the spherical casting sand of the present invention is preferably 0.2% or less. The urethane binder does not necessitate heating at the time of hardening and can thus enable production of a mold (particularly a core) having higher dimensional accuracy, and by using the casting sand having such coefficient of thermal expansion, the dimensional accuracy can also be preferably improved at the time of casting. The coefficient of thermal expansion of the spherical casting sand can be controlled by regulating the composition of casting sand, the crystalline structure, the proportion of amorphous components, etc.

As used herein, the coefficient of thermal expansion of the casting sand shall be the maximum value upon rapid thermal expansion at 1000° C., as determined according to JACT Test Method M-2.

The average particle diameter (mm) of the spherical casting sand of the present invention is preferably in the range of 0.03 to 1.5 mm. An average particle diameter of 0.03 mm or more is preferable because the casting sand does not require a large amount of the binder to produce a mold and can thus become easily reclaimed as casting sand. On the other hand, an average particle diameter of 1.5 mm or less is preferable because the void volume is reduced thus leading to improvement of mold strength and further because when spherical casting sand is produced by the flame fusion method, casting sand of high sphericity can be obtained. The average particle diameter is preferably 0.07 to 1 mm, more preferably 0.07 to 0.5 mm, even more preferably 0.07 to 0.35 mm, from the viewpoint of increasing the efficiency of reclamation of the spherical casting sand. From the viewpoint of increasing mold strength, the average particle diameter is preferably 0.05 to 1 mm. From the viewpoint of increasing both reclamation efficiency and mold strength, the average particle diameter is preferably 0.07 to 1 mm, more preferably 0.07 to 0.5 mm, even more preferably 0.07 to 0.35 mm.

In the cold box process that is a gas hardening method, the hardening reaction occurs by passing a gaseous tertiary amine, so from the viewpoint of air permeability, the average particle diameter of the spherical casting sand of the present invention is preferably 0.1 mm to 1.5 mm. From the viewpoint of increasing both air permeability and mold strength, the average particle diameter is preferably 0.1 mm to 0.5 mm, more preferably 0.1 mm to 0.3 mm.

The casting sand of the present invention has an effect of prolonging bench life, as compared with the casting sand known in the art. That is, the usual casting sand shows a reduction in strength upon gassing after the casting sand is kneaded with a polyol component and an isocyanate component and left, but when the casting sand of the present invention is used, the degree of reduction in strength is low or the the strength is even increased in some cases.

A mold (particularly a core) using the spherical casting sand of the present invention is excellent in filling properties because the casting sand is spherical, and the surface of the mold can be made smooth and the surface of a casting can be made smooth. From this viewpoint, the average particle diameter is preferably 0.03 to 1 mm, more preferably 0.03 to 0.35 mm, even more preferably 0.03 to 0.15 mm, even more preferably 0.03 to 0.1 mm.

In the present invention, the average particle diameter of the spherical casting sand can be determined as follows: That is, when the sphericity of the spherical casting sand is 1 as determined from a projected section of the sand particle, the diameter (mm) is measured, while in the case of the sphericity <1, the major axis (mm) and the manor axis (mm) of the spherical casting sand particle are measured to determine (major axis+minor axis)/2. In this measurement, arbitrary 100 spherical casting sand particles are measured and the average value is determined as average particle diameter (mm). The major axis and minor axis are defined as follows: The particle is stabilized on a plane, and when an image, projected on the plane, of the particle is sandwiched between 2 parallel lines, the minimum particle width expressed by the distance between the parallel lines is referred to as minor axis, while the distance between 2 parallel lines perpendicular to the above parallel line is referred to as major axis.

The major and minor axes of the spherical casting sand particle can be determined by image analysis of an image (photograph) of the particle obtained by an optical microscope or a digital scope (for example, VH-8000 manufactured by Keyence Corporation). The sphericity is determined by image analysis of the resulting image to determine the area of a projected section of the particle and the circumference of the section and then calculating [circumference (mm) of a circle having the same area as the area ($mm^2$) of the projected section of the particle]/[circumference (mm) of the projected section of the particle], wherein arbitrary 50 spherical casting sand particles are measured to determine their average as sphericity.

From the viewpoint of improving fluidity and of the smoothness of the surface of a mold, the sphericity of the spherical casting sand of the present invention is preferably 0.95 or more, more preferably 0.98 or more, even more preferably 0.99 or more.

From the viewpoint of improving mold strength and suppressing an increase in the amount of resin used due to absorption of the resin into the casting sand in producing a mold, the water absorption (wt %) of the spherical casting sand in the first aspect of the invention is preferably 1 wt % or less, more preferably 0.5 wt % or less, even more preferably 0.3 wt % or less, even more preferably 0.2 wt % or less, even more preferably 0.1 wt %. The water absorption can be measured according to a water absorption measurement method for aggregate in JIS A1109. In the case of RCS coated with a binder or when a binder remains after casting, such component is removed by a suitable method such as thermal treatment (for example 1000° C. or more) prior to measurement of water absorption.

On one hand, the water absorption of the spherical casting sand in the second aspect of the invention is 0.5 wt % or less. From the viewpoint of improving mold strength and suppressing an increase in the amount of resin used due to absorption of the resin into the casting sand in producing a mold, the water absorption is preferably 0.3 wt % or less, more preferably 0.2 wt % or less, even more preferably 0.1 wt % or less.

Given the same sphericity, the water absorption of the spherical casting sand produced by the flame fusion method is usually lower than that of the counterpart sand produced by the calcining method as another method.

From the viewpoint of improving bench life, the sphericity is preferably 0.95 or more, more preferably 0.97 or more, even more preferably 0.98 or more, even more preferably 0.99 or more. The water absorption is preferably 1 wt % or less, more preferably 0.5 wt % or less, even more preferably 0.3 wt % or less, even more preferably 0.2 wt % or less, even more preferably 0.1 wt % or less.

The reason that the spherical casting sand of the present invention when used together with the urethane binder can achieve an effect of prolonging bench life as a problem unique to the urethane binder is not evident at present, and is estimated as follows:

As the urethane binder, a phenol resin component and a polyisocyanate component are mixed and a gaseous amine is passed therethrough, thereby hardening a mold, but before passing the amine, the urethanization reaction may gradually proceed to initiate hardening, as described above.

Particularly, the polyisocyanate component is highly reactive thus not only undergoing the urethanization reaction but reacting also with moisture in air. Further, the reaction of isocyanate might be promoted by impurities on the surface of sand.

The spherical casting sand of the present invention has low water absorption, and a small surface area due to high sphericity because of its production through the flame fusion method, so it is estimated that the frequency for the binder to contact with the surface of the casting sand, particularly with impurities, is relatively low, and given the same additive amount, a film of the binder is thickened so that the frequency for the binder to contact with moisture in air is relatively reduced, and as a result, the isocyanate as a unique component of the urethane binder refrains from reaction before passage of amine.

As compared with the casting sand known in the art, a film thickness of the binder film can be thickened with a smaller additive amount, so it is estimated that the above effect can be achieved without generating gas defects.

The spherical casting sand of the present invention can be used alone or in a suitable combination with a conventionally known casting sand such as silica sand or refractory aggregate, and also with conventionally known additives. When the spherical casting sand of the present invention is added increasingly to the known casting sand described above, the desired effect of the invention described above can be demonstrated increasingly, depending on the amount of the spherical casting sand added. This effect becomes significantly remarkable when the spherical casting sand of the invention having the predetermined sphericity is contained preferably in an amount of 50 wt % or more, more preferably 80 wt % or more, in the casting sand containing of the mixture described above.

Fine powder of 0.01 mm or less may be contained in the casting sand containing the mixture described above, but from the viewpoint of improving strength, the content of fine powder of 0.01 mm or less in the casting sand containing the mixture is preferably 0.1 wt % or less, more preferably 0.05 wt % or less.

As described above, the spherical casting sand in the first aspect of the invention is produced by the flame fusion method. The spherical casting sand in the second aspect of the invention, on the other hand, can be produced by methods known in the art, such as a method of granulation and subsequent sintering and an electric fusion atomizing method. It is produced more preferably by the same flame fusion method as in the first aspect of the invention. The method of producing the spherical casting sand of the present invention by the flame fusion method includes a flame fusion method as shown in JP-A 2004-202577.

That is, refractory powder particles having an average particle diameter of 0.05 to 2 mm for example is used as the starting material, and the powder particles are dispersed in a carrier gas such as oxygen and fused in a flame shown below to make them spherical. The flame used may be a flame generated by burning, with oxygen, fuels such as propane, butane, methane, natural liquefied gas, LPG, heavy oil, kerosene, light oil and powdered coal, or a plasma jet flame generated by ionization of $N_2$ inert gas etc.

From the viewpoint of bench life, the casting sand is preferably washed and dried before and/or after treatment by the flame fusion method. For this washing, it is possible to use not only water but also an acid or alkali aqueous solution, each kind of surfactant, etc.

The spherical casting sand of the present invention is used together with the urethane binder. The urethane binder is a binder using both a polyol compound (particularly phenol resin) and a polyisocyanate compound as a binder and utilizing their polyaddition reaction to harden a mold.

The polyol compound in the urethane binder includes, but is not limited to, conventionally known phenol resins and aliphatic polyols. Specific example of the polyol compound include benzyl ether type phenol resin, resol type phenol resin, novolac type phenol resin, orthocresol modified phenol resin, and modified phenol resin thereof, as well as a mixture thereof, which are soluble in solvent and obtained by addition/condensation reaction of a phenol with an aldehyde (preferably formaldehyde).

From the viewpoint of reduction in viscosity, compatibility with a polyisocyanate component described later, coating on casting sand, mold physical properties, etc., the phenol resin is used generally preferably in the form of a solution in which the resin is dissolved in a solvent at a concentration of about 30 to 80 wt %.

The polyisocyanate compound in the urethane binder is a compound having, in its molecule, 2 or more isocyanate groups which can polyaddition-react with active hydrogens of the above-mentioned polyol compound thereby forming a chemical bond between casting sands, and specific examples of such polyisocyanate compounds include a wide variety of conventionally known polyisocyanates including not only aromatic, aliphatic or alicyclic polyisocyanates such as diphenylmethane diisocyanate, polymethylene polyphenylene polyisocyanate (referred to hereinafter as polymeric MDI), hexamethylene diisocyanate, and 4,4'-dicyclohexylmethane diisocyanate but also prepolymers having 2 or more isocyanate groups obtained by reacting such polyisocyanate compounds with polyols such as polyether polyol and polyester polyol, and these compounds can be used alone or as a mixture of two or more thereof.

For the same reason described above for the polyol compound, the polyisocyanate compound is used preferably as a solution in which it is dissolved in an organic solvent at a concentration of about 40 to 90 wt %.

The solvent used for the polyol compound and polyisocyanate compound is not particularly limited insofar as it is unreactive with the polyisocyanate compound and is a good solvent for the solute to be dissolved therein (phenol resin or polyisocyanate), and conventionally known solvents such as organic solvent and inorganic solvent can be used.

A polar solvent for dissolving the phenol resin, and a nonpolar solvent for dissolving the polyisocyanate compound in such an amount as not to cause separation of the phenol resin, are preferably combined and used as the organic solvent.

The polar solvent for dissolving the phenol resin includes alkyl dicarboxylates such as a methyl dicarboxylate mixture (trade name: DBE, manufactured by DuPont; a mixture of dimethyl glutarate, dimethyl adipate and dimethyl succinate), vegetable oil methyl esters such as rapeseed oil methyl ester, esters such as aliphatic monoesters such as ethyl oleate, ethyl palmitinate, and mixtures thereof, as well as ketones such as isophorone, ethers such as isopropyl ether, and furfuryl alcohol.

The nonpolar solvent for dissolving the polyisocyanate compound in such an amount as not to cause separation of the phenol resin can be exemplified by petroleum hydrocarbons such as paraffin, naphthene and alkyl benzene, specifically Ipuzol 150 (petroleum solvent manufactured by Idemitsu Sekiyu K.K.) and Highzol (petroleum solvent manufactured by Showa Shell Sekiyu K.K.).

The inorganic solvent includes alkyl silicates and hydrolysates thereof, for example silicate hydrolysates such as hydrolysates of methyl silicate, ethyl silicate, propyl silicate and butyl silicate. These are used alone or in combination with an organic solvent, from the viewpoint of strength improvement, reduction in gas generation, and improvement of collapsibility.

The urethane binder uses the polyol compound and the polyisocyanate compound preferably at a polyol compound/polyisocyanate compound weight ratio in the range of 100/110 to 100/160, more preferably in the range of 100/120 to 100/155.

The major components of the urethane binder are the polyol compound and polyisocyanate compound and optionally contain a solvent. From the viewpoint of mold strength, the amount of the urethane binder used (or the amount of the urethane binder and a solvent if the solvent is contained) is preferably 0.3 to 3 parts by weight, more preferably 0.3 to 2.2 parts by weight, more preferably 0.3 to 1.7 parts by weight, based on 100 parts by weight of casting sand containing the spherical casting sand of the invention.

A hardening catalyst for the urethane binder, which can be used in the present invention, is preferably a tertiary amine compound, and by way of example, an easily gasified compound formed into gas or aerosol, such as triethylamine, dimethylethylamine, dimethyl n-propylamine or dimethyl isopropylamine can be preferably used in the cold box mold making method, and 4-phenyl propyl pyridine, ethyl morpholine, N-methyl imidazole or the like can be preferably used as it is or after suitable dilution with an organic solvent, in the urethane self-hardening mold making method. Such hardening catalyst for the urethane self-hardening mold making method can be previously added to and mixed with the polyol compound component of the urethane binder. In either the cold box mold making method or the urethane self-hardening mold making method, the amount of the hardening catalyst is preferably 0.1 to 20 parts by weight based on 100 parts by weight of the polyol compound.

By way of example, the method for manufacturing a casting mold by using the spherical casting sand of the present invention includes a method for manufacturing a casting mold which includes adding a binder containing an organic solvent solution containing primarily a polyol compound, and a polyisocyanate compound or an organic solvent solution containing primarily a polyisocyanate compound, to the spherical casting sand of the present invention, mixing the mixture under stirring, charging a pattern with the resulting mixture, then contacting the mixture with a gaseous or aerosol tertiary amine thereby to cure it.

Another example of the method for manufacturing a casting mold by using the spherical casting sand of the present invention includes a method for manufacturing a casting mold which includes adding a binder containing an organic solvent solution containing primarily a polyol compound, and a polyisocyanate compound or an organic solvent solution containing primarily a polyisocyanate compound, and a liquid tertiary amine as a hardening catalyst, to the spherical casting sand of the present invention, mixing the mixture under stirring, charging the resulting mixture into a pattern, and curing it.

In production of a mold by using the spherical casting sand of the present invention, conventionally known additives, that is, a silane coupling agent, a collapsibility improver, a smell-reducing agent, a bench life-prolonging agent, a sticker-preventing agent, a strength improver etc. can be used. From the viewpoint of collapsibility property, the silane coupling agent is contained preferably in an amount of 0.01 to 10 parts by weight based on 100 parts by weight of the urethane binder.

As an example of the collapsibility improver, mention is made of silicates, silica sol, organohalophosphates, phosphites, alkali metal oxyacid salts, and at least one kind of metal oxide having one kind of metal element selected from the group of iron, copper, nickel, cobalt and zinc.

Examples of the smell-reducing agent include carboxylic acids such as fumaric acid, alkali metal salts, alkaline earth metal salts and inorganic oxides.

Examples of the bench life-prolonging agent and the method of prolonging bench life include acid chlorides such as isophthalic acid chloride, phosphite, 2,2'-dipyridyl, 1,10-phenanthroline, and alkyl derivatives substituted therewith, and aromatic compounds such as catechol and pyrogallol, boron compounds such as boric acid and a method of using a binder composition containing 50 ppm or less divalent metal salt and a method of combining epoxy resin, acrylated organic polyisocyanate, a reactive unsaturated acrylic monomer, a polymer, and a mixture thereof, and an oxidizing agent of hydroperoxide.

Examples of the sticker-preventing agent include urethane prepolymers produced by reacting an aliphatic monoisocyanate or polyisocyanate with polyether polyol, as well as polybutadiene, functional polybutadiene, and modified polybutadiene having a phenolic hydroxyl group.

Examples of the strength improver include acid amides, urea derivatives, etc.

In production of a mold by using the spherical casting sand of the present invention, the amount of the urethane binder added can be reduced (that is, the amount of gas generated can be significantly reduced), and thus gas defects as the problem of the urethane binder can be significantly reduced, and simultaneously high strength can be brought about, thus enabling production of mold such as a core having a complicated shape, particularly a thin-wall portion, with high productivity. The spherical casting sand of the present invention can be used to prevent imperfect filling with high fluidity in a mold (particularly a core) having a thin-walled portion of 5 mm or less in thickness, preferably 4 mm or less. The mold having a thin-walled portion of 5 mm or less refers to a mold whose thinnest portion after molding has a thickness of 5 mm or less.

The spherical casting sand of the present invention has high sphericity and high chargeability to make the surface of a mold smooth thus providing a casting with a smooth surface, that is, a smooth casting surface.

That is, a mold such as a core obtained by using the spherical casting sand of the present invention can be used to smooth a casting surface in a portion not capable of post-treatment because of its complicated shape, is thus useful for a casting member having a complicated hole through which a fluid passes, can reduce the resistance, due to roughness of the surface of a casting, and can achieve the energy saving and downsizing of an apparatus using this casting member.

The surface roughness Ra of a mold containing the spherical casting sand of the present invention and the urethane binder is preferably 20 μm or less, more preferably 1 to 15 μm. Ra can be measured with a surface roughness measuring instrument, as described later in the Examples.

Since the spherical casting sand of the present invention is spherical, a mold with the sand can thus easily collapsed after casting and the sand can easily removed even from the mold even having a complicated shape. The spherical casting sand of the present invention can also be preferably used in a lamination mold making method or in a cut mold because the sand in an unhardened portion and in an unnecessary portion can be easily removed.

The spherical casting sand of the present invention which was disrupted after molding or casting can be recycled. For this recycling, the spherical casting sand can be subjected to reclaim treatments such as a method known in the art, mechanical treatment such as roasting treatment or inter-particle friction method, and treatments such as water washing, acid washing, alkali washing, and solvent washing. The casting sand subjected to such reclaim treatments, that is, the reclaimed sand, can be used again in producing the mold of the present invention.

The sphericity and water absorption of the spherical casting sand thus reclaimed are measured after the binder component is removed if necessary depending on the type of binder. For example, when an organic binder is contained, its organic matter is removed at 1000° C. for 1 hour prior to measurement of sphericity and water absorption. When an inorganic binder is contained, a method such as water washing, acid washing or alkali washing is adopted.

Particularly, a core obtained by using the spherical casting sand of the present invention makes use of the sand having high sphericity, and is thus excellent in air permeability and can also be used preferably in casting procedures in fields requiring air permeability in molds, such as evaporative pattern casting, full-mold method, vacuum sealed process, vacuum casting etc., and such core can reduce the amount of gas generated, and can thus be preferably used in metal mold casting where gas defects or resin defects easily occur, for example, low-pressure casting and high-pressure casting, or as a core for die casting.

The core of the present invention can be used for a casting having a very complicated structure and requiring a beautiful casting surface and dimensional accuracy. The core can be more preferably used for parts having a surface on which fluid such as gas or liquid passes or for parts having some of the above parts, combined and integrated with one another.

Specific examples of such parts include water valves, hydraulic valves, piping parts, motor parts with a complicated fin portion (casings), pump parts requiring smoothness (impellers etc.), engine parts (frames), parts in driving transmission devices, dies, parts in metal cutting machine tools, building components, etc.

The mold (e.g. the core) of the invention can be used to obtain a casting having a surface roughness of 10 μm or less, and can be used preferably in producing a casting composed of cast steel, cast iron, aluminum, copper, magnesium or an alloy thereof. In the present invention, the amount of the urethane binder added can be reduced thereby reducing the amount of gas generated from the mold, which is preferable for materials severe toward defects by gas, such as copper, aluminum and magnesium.

EXAMPLES

Figure 1:
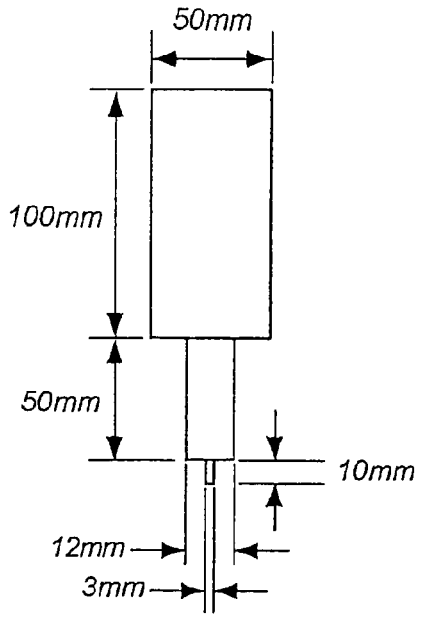
FIG. 1 is a schematic view of a core used in the Examples and Comparative Examples.

The present invention is described in more detail by reference to the Examples below. The Examples are merely illustrative of the present invention and not intended to limit the present invention.

Hereinafter, the casting sands used in the Examples and Comparative Examples are shown. Their compositions and physical properties are shown in Table 1.

Spherical Casting Sand (1):

Spherical casting sand obtained by the flame fusion method, having an average particle diameter of 0.15 mm, a sphericity of 0.98, a water absorption of 0.02 wt %, an acid consumption of 1.3 ml/50 g, and a composition containing 63.8 wt % $Al_2O_3$, 30.2 wt % $SiO_2$, 1.3 wt % $Fe_2O_3$, 2.9 wt % $TiO_2$, 0.3 wt % CaO, 0.1 wt % MgO, 0.1 wt % $Na_2O$, 0.1 wt % $K_2O$ (composition was measured according to JIS R 2212; this hereinafter applies).

Spherical Casting Sands (2) to (5):

Spherical casting sands obtained by the flame fusion method, being different from spherical casting sand (1) in composition and physical properties.

Conventional Casting Sand (1):

Mullite sand obtained by the granulation calcination method, which was obtained by mixing aluminum hydroxide with kaolin such that the $Al_2O_3/SiO_2$ weight ratio became 2.7, then drying the mixture by a spray drier to give powder particles having an average particle diameter of 0.2 mm (containing $Al_2O_3$ and $SiO_2$ in a total amount of 96 wt %), and calcining the powder particles in an electric furnace at 1500° C. for 1 hour to give the mullite sand. The total content of $Al_2O_3$ and $SiO_2$ was 97 wt %, the $Al_2O_3/SiO_2$ ratio by weight was 2.7, the average particle diameter was 0.18 mm, the sphericity was 0.89, the water absorption was 1.2 wt %, the acid consumption was 1.6 ml/50 g, and the particle density was 2.7 g/cm$^3$.

Conventional casting sand (2): Silica Sand (Albany No. 7) with an average particle diameter of 0.18 mm, a sphericity of 0.88, a water absorption of 0.80 wt %, and an acid consumption of 1.3 ml/50 g.

TABLE 1

| | Casting sand composition (wt %) | | | | | | | | | Average particle diameter | Water absorption | Acid comsumption | Amount of eluted alkali (μmol/1 g of casting |
|---|---|---|---|---|---|---|---|---|---|---|---|---|---|
| | $Al_2O_3$ | $SiO_2$ | $Fe_2O_3$ | $TiO_2$ | CaO | MgO | $Na_2O$ | $K_2O$ | Sphericity | (μm) | (wt %) | (ml/50 g) | sand) |
| Spherical casting sand(1) | 63.8 | 30.2 | 1.3 | 2.9 | 0.3 | 0.1 | 0.1 | 0.1 | 0.98 | 0.15 | 0.02 | 1.3 | 0.15 |
| Spherical casting sand(2) | 48.8 | 46.0 | 0.9 | 1.5 | 0.3 | 0.1 | 0.1 | 0.2 | 0.99 | 0.14 | 0.01 | 2.1 | 0.00 |
| Spherical casting sand(3) | 52.9 | 34.6 | 2.2 | 3.2 | 0.3 | 0.2 | 0.1 | 0.4 | 0.95 | 0.17 | 0.15 | 4.5 | 0.85 |
| Spherical casting sand(4) | 69.9 | 23.5 | 1.4 | 2.4 | 0.3 | 0.1 | 0.1 | 0.1 | 0.97 | 0.14 | 0.02 | 4.2 | 0.41 |
| Spherical casting sand(5) | 65.0 | 29.2 | 1.2 | 2.8 | 0.6 | 0.2 | 0.1 | 0.1 | 0.98 | 0.20 | 0.04 | 5.4 | 0.94 |
| Conventional casting sand(1) | 70.8 | 26.2 | 1.2 | 0.8 | 0.3 | 0.1 | 0.1 | 0.2 | 0.89 | 0.18 | 1.20 | 1.6 | 0.00 |
| Conventional casting sand(2) | 0.0 | 99.8 | 0.0 | 0.0 | 0.0 | 0.0 | 0.0 | 0.0 | 0.88 | 0.18 | 0.80 | 1.3 | 0.00 |

Examples 1 To 4 And Comparative Examples 1 To 3

The casting sands shown in Table 1 were used as shown in Table 2, and used together with the urethane binders in Table 2, to prepare kneaded sands for mold which were then evaluated as shown below. The results are shown in Table 2.

<Evaluation>

(1) Transverse Strength 100 parts by weight of casting sand shown in Table 2, a polyol compound solution in organic solvent (trade name: "ISOCURE Part I", manufactured by Hodogaya Ashland Co., Ltd.) in the amount shown in Table 2 and a polyisocyanate compound solution in organic solvent (trade name: "ISOCURE Part II", manufactured by Hodogaya Ashland Co., Ltd.) in the amount shown in Table 2 were mixed at room temperature by a mixer to prepare kneaded sand for mold which was then introduced into a form of 10 mm in thickness×30 mm in width×80 mm in length, and triethylamine was injected into it in an amount of 5 wt % based on the polyol compound solution in organic solvent, followed by gasification and passing the gas for 40 seconds, thereby hardening the casting sand which was then released from the form. After 24 hours, the product was measured for its transverse strength (transverse rupture strength) by a strength testing machine AG-5000D manufactured by Shimadzu Corporation.

(2) Evaluation at the Time of Pouring

Figure 2:
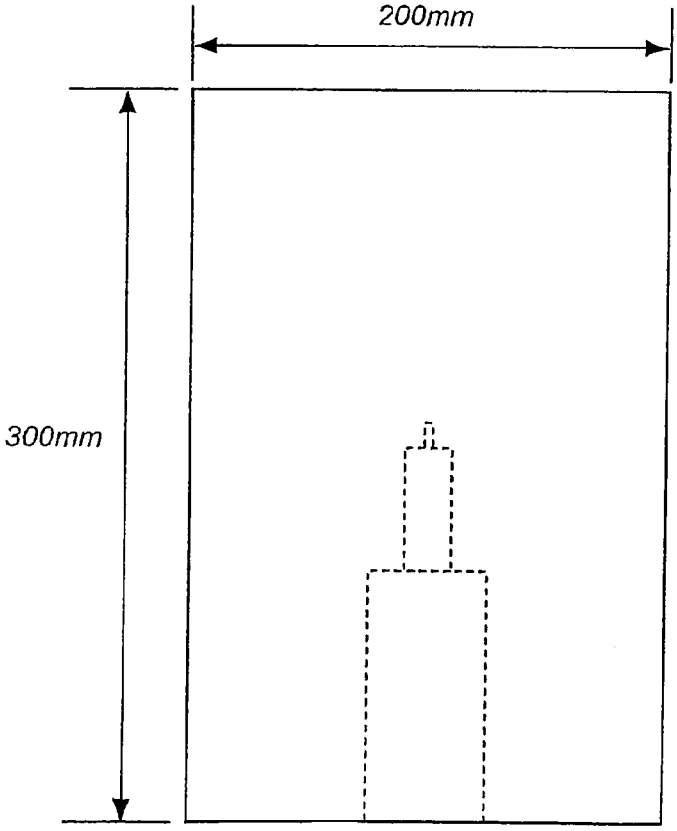
FIG. 2 is a schematic view of a casting produced in the Examples and Comparative Examples.

Kneaded sand for mold prepared in the same manner as in (1) above and triethylamine were used as shown in Table 2 to prepare a core with the shape shown in FIG. 1, and the core was set in a casting mold (main form) with the shape shown in FIG. 2, and a melt of casting iron (FC250) was poured into it, and whether gas defects and core rupture after pouring occurred or not was evaluated.

The resulting casting was cut across the central portion in a longitudinal direction, and the number of gas defects (pinhole defects) on the cut surface was determined as the number of red spots by a dye penetrant test (color check). The core rupture after pouring was evaluated by observing the shape of the core portion of the cut surface and confirming whether rupture (including deformation) occurred or not.

The main form was prepared from the same casting kneaded sand as that of the core by using a self-hardening mold using a phenol urethane binder in the same amount as that of the urethane binder. This phenol urethane binder contains a polyol compound solution in organic solvent (trade name: "PEPSET Part R", manufactured by Hodogaya Ashland Co., Ltd.), a polyisocyanate compound solution in organic solvent (trade name: "PEPSET Part M", manufactured by Hodogaya Ashland Co., Ltd.), and a hardening catalyst (trade name: "PEPSET Part K", manufactured by Hodogaya Ashland Co., Ltd.).

The results are shown in Table 2 where in evaluation of gas defects, "⊙" means that no gas defect was observed, "○" means that 1 to 4 gas defects occurred, and "x" means that 5 or more gas defects occurred.

solvent (trade name: "ISOCURE Part I", manufactured by Hodogaya Ashland Co., Ltd.) and 0.8 part by weight of a polyisocyanate compound solution in organic solvent (trade name: "ISOCURE Part II", manufactured by Hodogaya Ashland Co., Ltd.) were mixed at 20° C. by a mixer to prepare kneaded sand for mold. Just after kneading and 2 hours after kneading (stored in a polyethylene cup in the air), the sand was introduced into a form of 22 mm in thickness×22 mm in width×180 mm in length, and triethylamine was injected in an amount of 0.14 wt % into the sand, then gasified and passed therethrough for 30 seconds, thereby hardening the sand which was then released from the form. 10 minutes after release, the product was measured for its bending strength (transverse strength) by a GF transverse strength testing machine (distance between supporting points: 150 mm). The degree of reduction of strength (%) was determined according to the equation: the degree of reduction of strength=[(transverse strength 2 hours after kneading)/(transverse strength just after kneading)]×100.

TABLE 2

| | | Casting sand | Amount of urethane-based binder added (parts by weight) Polyol compound solution | Polyisocyanate compound solution | Total | Transverse strength (MPa) | Gas defects | Core rupture after pouring |
|---|---|---|---|---|---|---|---|---|
| Example | 1 | Spherical casting sand (1) | 0.3 | 0.3 | 0.6 | 2.5 | ⊙ | No |
| | 2 | Spherical casting sand(1) | 0.5 | 0.5 | 1 | 3.8 | ⊙ | No |
| | 3 | Spherical casting sand(1) | 0.75 | 0.75 | 1.5 | 5.8 | ⊙ | No |
| | 4 | Spherical casting sand(1) | 1 | 1 | 2 | 7.2 | ○ | No |
| Comparative example | 1 | Conventional casting sand(1) | 1.25 | 1.25 | 2.5 | 4.6 | X | No |
| | 2 | Conventional casting sand(1) | 0.5 | 0.5 | 1 | 1.9 | ○ | Yes |
| | 3 | Conventional casting sand(2) | 1.25 | 1.25 | 2.5 | 4.7 | X | No |

In Table 2, the amount of the urethane binder added is the amount of the urethane binder based on 100 parts by weight of the casting sand.

The smoothness of the surface of a mold produced by using the casting sand obtained in Example 2 or Comparative Example 1, and the smoothness of the surface of a casting produced by using the mold, were measured as surface roughness [central line average roughness: Ra (μm)] by a surface roughness measuring device (Surfcoder SE-30H, manufactured by Kosaka Kenkyusho). Smaller Ra is indicative of higher surface smoothness. The results are shown in Table 3. As can be seen from Table 3, the casting sand in Example 2 gave a mold more excellent in surface smoothness than the casting sand in Comparative Example 1, and the surface of a casting produced by using the mold obtained therefrom is also excellent in smoothness.

TABLE 3

| | | Example 2 | Comparative example 1 |
|---|---|---|---|
| Surface roughness Ra (μm) | Mold surface | 14 | 32 |
| | Casting surface | 8 | 13 |

Examples 5 To 9 And Comparative Examples 4 To 5

Using the casting sand in Table 1, bench life was evaluated by the following method. The results are shown in Table 4.

<Evaluation of Bench Life>

100 parts by weight of the casting sand shown in Table 1, 0.8 part by weight of a polyol compound solution in organic

TABLE 4

| | | Casting sand | Transverse strength (MPa) Just after kneading | 2 hours after kneading | Degree of reduction of strength (%) |
|---|---|---|---|---|---|
| Example | 5 | Spherical casting sand (1) | 5.5 | 6.2 | 113 |
| | 6 | Spherical casting sand (2) | 6.7 | 7.1 | 106 |
| | 7 | Spherical casting sand (3) | 4.3 | 4.1 | 95 |
| | 8 | Spherical casting sand (4) | 6.2 | 6.7 | 108 |
| | 9 | Spherical casting sand (5) | 5.3 | 4.9 | 92 |
| Comparative example | 4 | Conventional casting sand(1) | 2.1 | 1.8 | 86 |
| | 5 | Conventional casting sand(2) | 3.8 | 3.3 | 87 |

Example 10 And Comparative Examples 6 To 7

Molds were produced by using the casting sands in Table 1 by the self-hardening mold making method and then evaluated for their strength as follows. The results are shown in Table 5.

<Evaluation of Strength of Self-Hardened Mold>

100 parts by weight of (some of) the casting sands shown in Table 1, 0.6 part by weight of a polyol compound solution in organic solvent (trade name: "Paraset Part R", manufactured by Kobe Rika Co., Ltd.), 0.6 part by weight of a polyisocyanate compound solution in organic solvent (trade name: "Paraset Part M", manufactured by Kobe Rika Co., Ltd.) and 0.03 part by weight of a hardening catalyst (trade name: "Paraset Part K", manufactured by Kobe Rika Co., Ltd.) were mixed at 25° C. by a mixer to prepare kneaded sands for mold which were then used to prepare ϕ50 mm×50 mm molds by the self-hardening mold making method, and 30 minutes and 1 day (24 hours) after kneading was finished, the molds were measured for their compressive strength by a compressive strength testing machine.

TABLE 5

| | Casting sand | Compression strength (MPa) | |
|---|---|---|---|
| | | after 30 minutes | after 24 hours |
| Example 10 | Spherical casting sand(1) | 2.85 | 9.49 |
| Comparative example 6 | Conventional casting sand(1) | 0.80 | 3.84 |
| Comparative example 7 | Conventional casting sand(2) | 1.92 | 7.86 |

The invention claimed is:

1. A method for manufacturing a mold, comprising a step of mixing spherical casting sand having an average particle diameter of 0.03 to 1.5 mm, produced by a flame fusion method with a urethane hinder, wherein the spherical casting sand comprises eluted alkali of 0.41 μmol/g or lower, $K_2O$ of 0.3% by weight or less, CaO of 0.5% by weight or less, MgO of 0.1% by weight or less and $Na_2O$ of 0.1% by weight or less, and the spherical casting sand has a sphericity of 0.95 or more.

2. The method for manufacturing a mold according to claim 1, wherein a urethane binder is mixed in an amount of 0.3 to 2.2 parts by weight based on 100 parts by weight of the spherical casting sand.

3. The method for manufacturing a mold according to claim 1, wherein the spherical casting sand has a water absorption of 0.5 wt % or less.

4. The method for manufacturing a mold according to claim 1, wherein the spherical casting sand comprises $Al_2O_3$ and $SiO_2$ as major components at an $Al_2O_3/SiO_2$ weight ratio of 1 to 15.

5. A mold comprising:

spherical casting sand having an average particle diameter of 0.03 to 1.5 mm, produced by a flame fusion method; and a urethane hinder, wherein, the spherical casting sand comprises eluted alkali of 0.41 μmol/g or lower, $K_2O$ of 0.3% by weight or less, CaO of 0.5% by weight or less, MgO of 0.1% by weight or less and $Na_2O$ of 0.1% by weight or less, and the spherical casting sand has a sphericity of 0.95 or more.

6. The mold according to claim 5, which has a surface roughness Ra of 20 μm or less.

7. The mold according to claim 5 or 6, which has a portion with a wall thickness of 5 mm or less.

8. The mold according to claim 5, wherein the mold is a core.

9. The mold according to claim 5, which comprises a urethane binder in an amount of 0.3 to 2.2 parts by weight based on 100 parts by weight of the spherical casting sand.

10. The mold according to claim 5, wherein the spherical casting sand has a water absorption of 0.5 wt % or less.

11. The mold according to claim 5, wherein the spherical casting sand comprises $Al_2O_3$ and $SiO_2$ as major components at an $Al_2O_3/SiO_2$ weight ratio of 1 to 15.

* * * * *